US009675227B2

(12) United States Patent
Potoroka

(10) Patent No.: US 9,675,227 B2
(45) Date of Patent: Jun. 13, 2017

(54) VACUUM CLEANER WITH SWIVEL AND SWING HANDLE

(76) Inventor: Andrew John Potoroka, Seattle, WA (US)

( * ) Notice: Subject to any disclaimer, the term of this patent is extended or adjusted under 35 U.S.C. 154(b) by 185 days.

(21) Appl. No.: 11/782,584

(22) Filed: Jul. 24, 2007

(65) Prior Publication Data

US 2008/0022483 A1 Jan. 31, 2008

Related U.S. Application Data

(60) Provisional application No. 60/820,229, filed on Jul. 25, 2006.

(51) Int. Cl.

| | |
|---|---|
| ***A47L 9/00*** | (2006.01) |
| ***A47L 9/32*** | (2006.01) |
| *A47L 11/22* | (2006.01) |
| *A47L 7/02* | (2006.01) |

(52) U.S. Cl.

CPC ..... *A47L 9/325* (2013.01); *A47L 7/02* (2013.01); *A47L 11/22* (2013.01)

(58) Field of Classification Search

USPC ..... 15/314, 315, 410

See application file for complete search history.

(56) References Cited

U.S. PATENT DOCUMENTS 205,069 A * 6/1878 Farnsworth ..... F16L 27/04 285/146.2
1,014,776 A * 1/1912 Rubel ..... A47L 9/325 119/606
1,040,191 A * 10/1912 Hale ..... F16L 27/04 285/146.2
1,836,348 A * 12/1931 Wardell ..... A47L 9/325 285/906
2,760,765 A * 8/1956 Roop ..... A01J 11/04 119/14.09
2,775,779 A * 1/1957 Nelson ..... A47L 13/24 15/144.1
2,854,683 A * 10/1958 Warden ..... A47L 13/146 15/144.2
3,325,196 A * 6/1967 Noirot ..... F16B 37/065 403/247
3,739,422 A * 6/1973 Johnson ..... A47L 9/02 15/397
4,079,520 A * 3/1978 Davis ..... G01C 9/28 33/373
4,266,317 A * 5/1981 Duda ..... A47L 11/30 15/144.2
4,381,117 A * 4/1983 French ..... B60D 1/06 280/204

(Continued)

*Primary Examiner* — Larry E Waggle, Jr.
*Assistant Examiner* — Alvin Grant

(57) ABSTRACT

The invention provides an upright vacuum cleaner with a swivel and swing handle fitted to the upper end of the upright portion of the vacuum cleaner using a ball and socket joint and a connecting bolt. Because of the ball and socket joint and a spiral spring surrounding the connecting bolt between the ball and socket joint and the upper end of the upright portion of the vacuum cleaner, the handle can freely swivel and rotate at any angle relative to the upright portion to provide enhanced flexibility in maneuvering the vacuum cleaner, thus effectively reducing the bodily stress and strain involved in using a vacuum cleaner.

6 Claims, 7 Drawing Sheets

(56) References Cited

U.S. PATENT DOCUMENTS 4,516,289 A * 5/1985 Sumerau ..... A47L 9/00 15/143.1
4,654,922 A * 4/1987 Chen ..... A46B 5/0087 15/144.2
4,706,327 A * 11/1987 Getz ..... A47L 5/34 15/319
4,796,325 A * 1/1989 Bortman ..... A46B 5/0012 15/144.2
4,938,108 A * 7/1990 Mekler ..... B25B 13/20 411/396
5,220,704 A * 6/1993 Flynn ..... A47L 9/00 15/321
5,367,741 A * 11/1994 Hampton ..... A47L 5/30 15/315
5,467,502 A * 11/1995 Johnson ..... A47L 5/30 15/323
5,778,939 A * 7/1998 Hok-Yin ..... A47L 9/24 138/109
5,996,175 A * 12/1999 Fusco ..... A46B 5/0075 15/144.1
6,026,541 A * 2/2000 Bailey ..... A47L 5/24 15/344
6,108,862 A * 8/2000 Frederick ..... A47L 5/28 15/340.2
6,317,920 B1 * 11/2001 Brickner ..... A47L 5/28 15/334
7,055,204 B2 * 6/2006 Ajluni ..... A47L 1/06 15/121
7,090,626 B1 * 8/2006 Miller ..... A63B 21/4035 482/139
7,153,216 B1 * 12/2006 Pressley ..... A63B 69/3614 473/220
7,640,617 B2 * 1/2010 Kennedy ..... A47L 13/20 15/144.1
9,277,844 B1 * 3/2016 Millan ..... A47L 5/36
2002/0042969 A1 * 4/2002 Nagai ..... A47L 9/02 15/410
2002/0092116 A1 * 7/2002 Zahuranec ..... A47L 7/0009 15/320
2003/0009839 A1 * 1/2003 Streutker ..... A47L 13/24 15/228
2003/0009840 A1 * 1/2003 Karsten ..... B05C 17/022 15/230.11
2004/0157540 A1 * 8/2004 Wendt ..... B23Q 11/0046 451/358
2004/0200032 A1 * 10/2004 Morgan ..... A47L 9/2842 15/410
2006/0000041 A1 * 1/2006 Streutker ..... A47L 13/24 15/144.1
2006/0156509 A1 * 7/2006 Luebbering ..... A47L 5/30 15/410
2007/0039123 A1 * 2/2007 Bird ..... A47L 9/08 15/345
2007/0071540 A1 * 3/2007 Jung ..... A46B 5/0054 401/270
2007/0130723 A1 * 6/2007 Kelly ..... A47L 9/322 15/410
2007/0163075 A1 * 7/2007 Butler ..... A47L 9/02 15/410

* cited by examiner

VACUUM CLEANER WITH SWIVEL AND SWING HANDLE

CROSS-REFERENCE TO RELATED APPLICATIONS

This application claims the benefit of U.S. Provisional Application No. 60/820,229, filed Jul. 25, 2006, which is incorporated herein by reference.

BACKGROUND OF THE INVENTION

1. Field of the Invention

The invention relates to a vacuum cleaner with a swivel and swing handle. More particularly, the invention relates to an upright vacuum cleaner to which a swivel and swing handle is fitted through a ball and socket joint and an optional spiral spring.

2. Description of the Related Art

A typical upright vacuum cleaner, as shown in FIG. 1, comprises a wheeled base 21 equipped with a motor (not shown), an upright portion 22 with the lower end pivotally connected to the wheeled base 21, a handle 11 attached to the upper end of the upright portion 22, a dust bag 23 attached to one side of the upright portion 22, and a long electrical cord (not shown) for plugging in an electrical socket. The upright portion 22 and the handle 11 are either integrally formed, or separately formed and rigidly screwed, bolted, or otherwise connected together.

The handle 11 usually has an angled or curved end that forms a certain angle with the upright portion 22. Moreover, the pivotally connected upright portion 22 can be swiveled from its normal upright position up to nearly 90 degrees, to an almost horizontal position. This along with the angled or curved end of the handle 11 allows some limited flexibility for the user to flex its arm and wrist in maneuvering the vacuum cleaner.

However, because the handle 11 is integrally formed or rigidly connected with the upright portion 22, the user is often required to constantly twist the arm, wriggle the wrist or bend the back in maneuvering the vacuum cleaner around corners or obstacles or to reach under low clearance. As a result, the user would feel sore or even get injured in the arm, the wrist, or the back due to the constant twisting, wriggling and bending. The bodily stress and strain involved in using a conventional upright vacuum cleaner could be rather excessive to older folks who live by themselves and have to vacuum the floor themselves. This is especially so if the rooms to vacuum are clustered with furniture or other household items and a lot of turning around is needed.

What is needed, therefore, is an upright vacuum cleaner that can be moved around and maneuvered more easily with less effort than a conventional upright vacuum cleaner. The objective of the present invention is to fill this need with a new handle structure.

BRIEF SUMMARY OF THE INVENTION

Essentially, the invention provides an upright vacuum cleaner with a swivel and swing handle fitted to the upper end of the upright portion of the vacuum cleaner through a ball and socket joint and a connecting bolt. Because of the ball and socket joint, the swivel and swing handle can freely swivel and swing or rotate at an angle relative to the upright portion of the vacuum cleaner to provide enhanced flexibility in maneuvering the vacuum cleaner, thus effectively reducing the bodily stress and strain required in using a vacuum cleaner. Furthermore, a spiral spring surrounding the part of the connecting bolt between the ball and socket joint and the upper end of the upright portion of the vacuum cleaner can be further provided to allow the handle to return to its normal upright position when released.

DETAILED DESCRIPTION OF THE PREFERRED EMBODIMENTS

Figure 1:
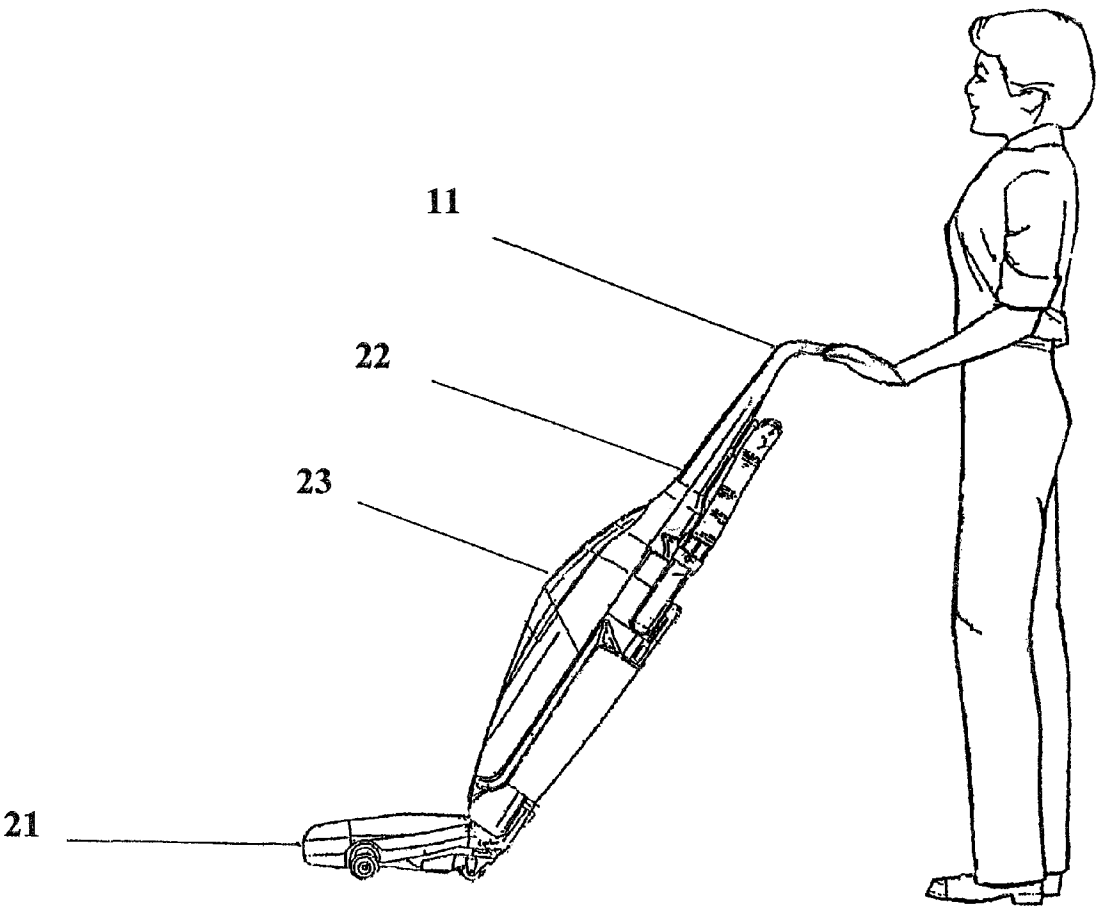
FIG. 1 PRIOR ART
FIG. 1 shows a conventional upright vacuum cleaner with a rigid handle.
Figure 2:
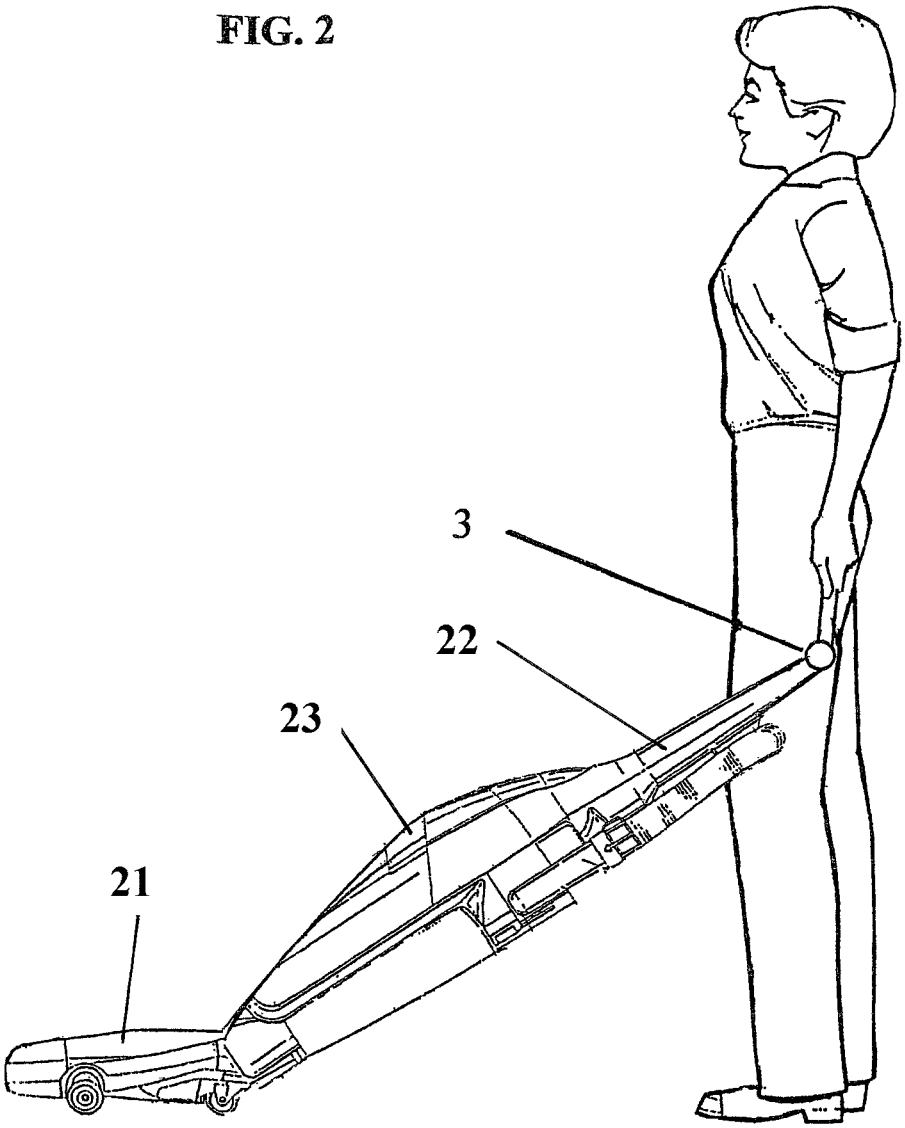
FIG. 2 shows an upright vacuum cleaner with a swivel and swing handle according to the present invention.
Figure 3:
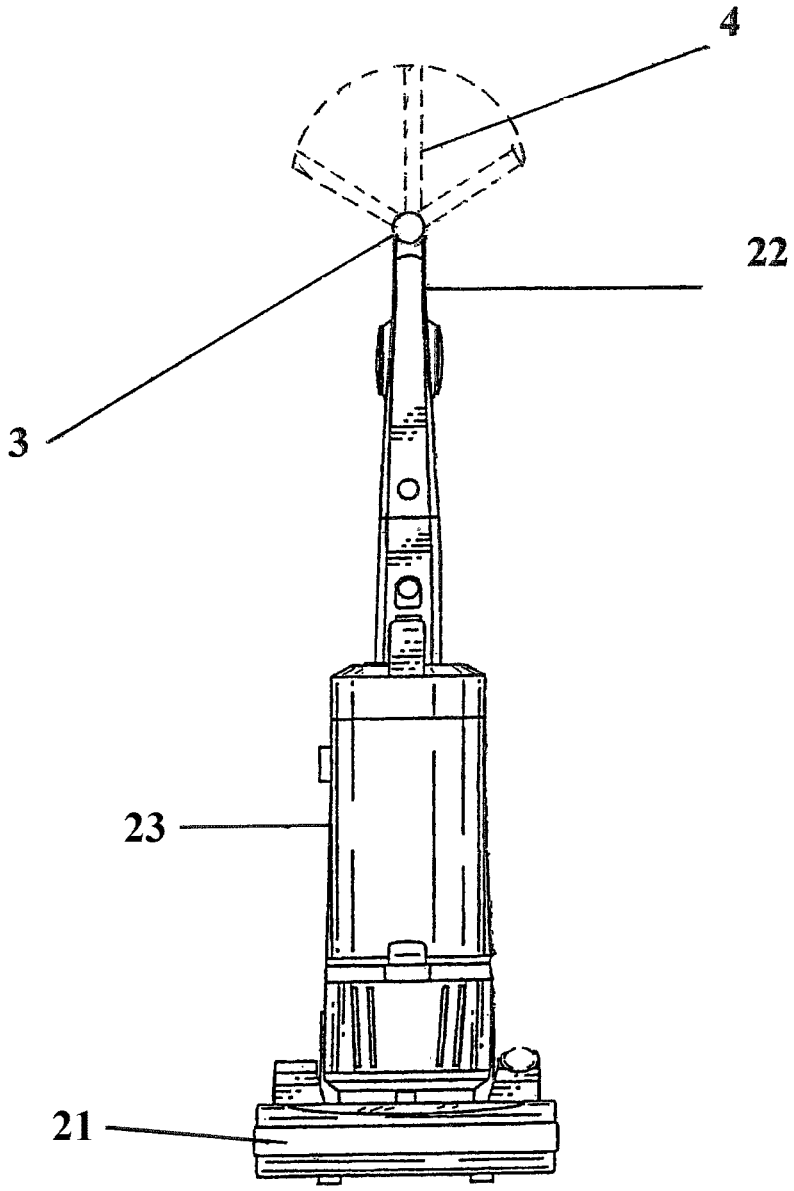
FIG. 3 illustrates the swiveling and swinging action of the swivel and swing handle according to the present invention.
Figure 4:
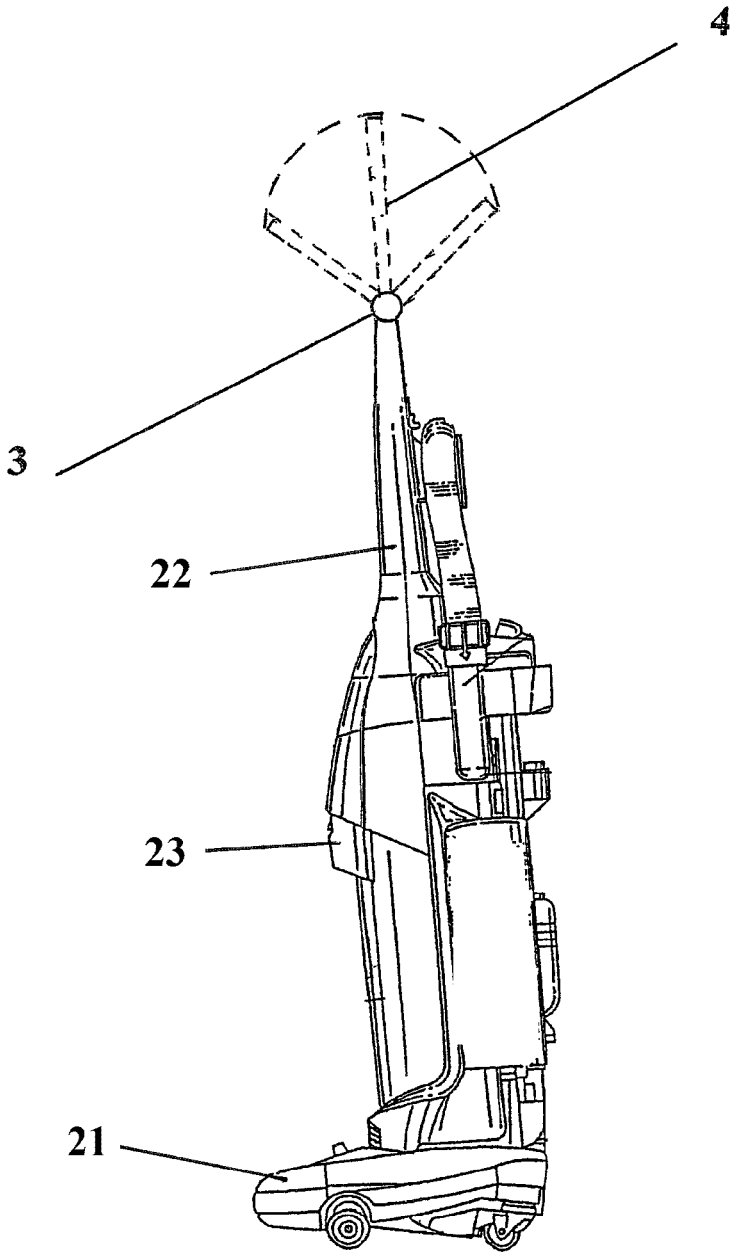
FIG. 4 shows a different view of the swiveling and swinging action of the swivel and swing handle.

FIGS. 2-4 shows an upright vacuum cleaner with a swivel and swing handle according to the present invention, which comprises a wheeled base 21 equipped with a motor (not shown), an upright portion 22 with the lower end pivotally connected to the wheeled base 21, a dust bag 23 attached to one side of the upright portion 22, a swivel and swing handle 4 having a ball and socket joint 3 connected to the upper end of the upright portion 22. Because of the ball and socket joint 3, the swivel and swing handle 4 can freely swivel and swing or rotate at an angle relative to the upright portion 22 of the vacuum cleaner. As shown in FIGS. 2-4, the swivel and swing handle 4 with the ball and socket joint 3 allows the user to hold the vacuum cleaner in a more flexible manner and at more comfortable angles than with a conventional upright vacuum cleaner.

Figure 5:
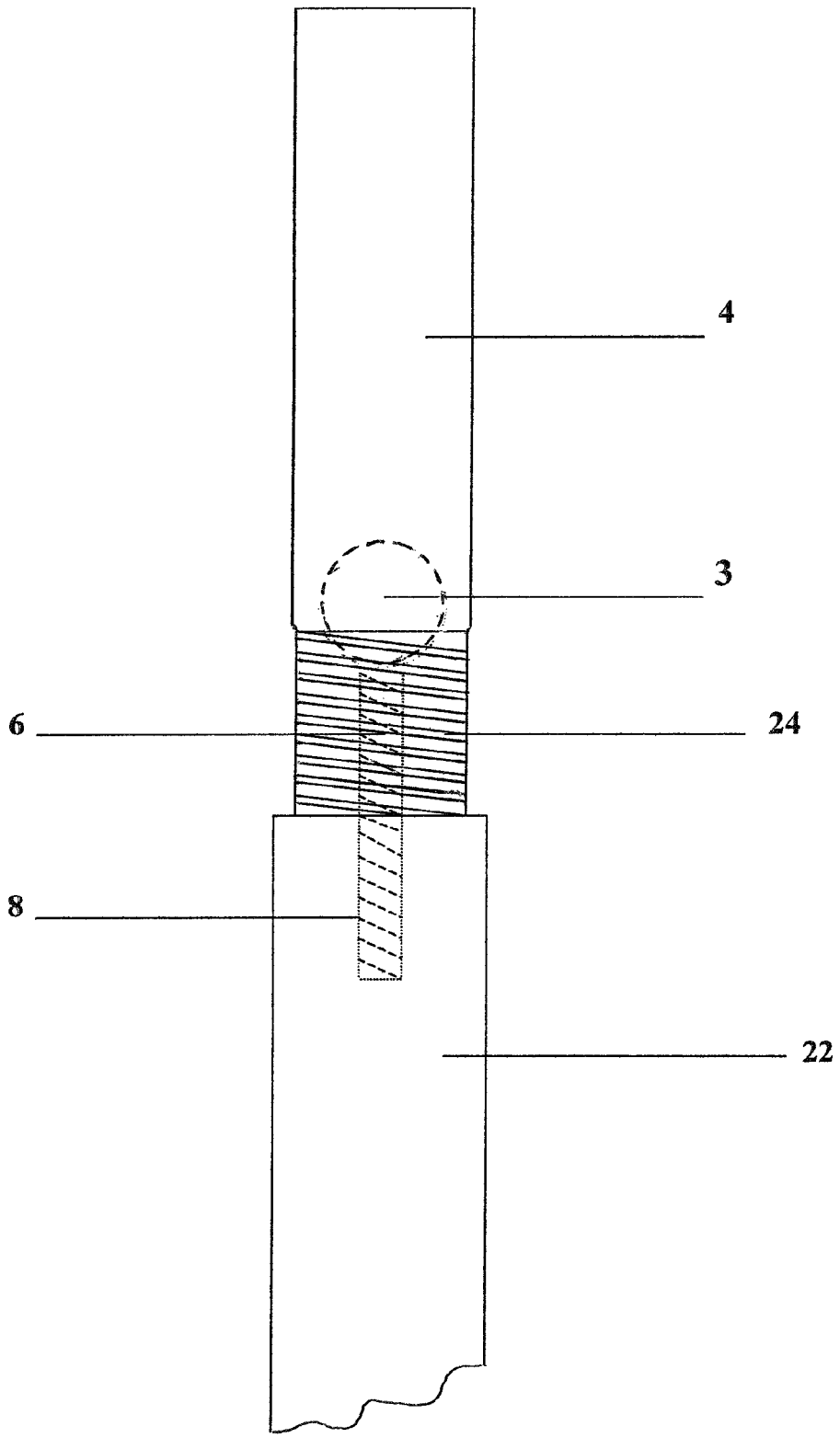
FIG. 5 shows a detailed view of the ball and socket joint of the swivel and swing handle and its connection to the upper end of the upright portion of the vacuum cleaner according to the present invention.
Figure 7:
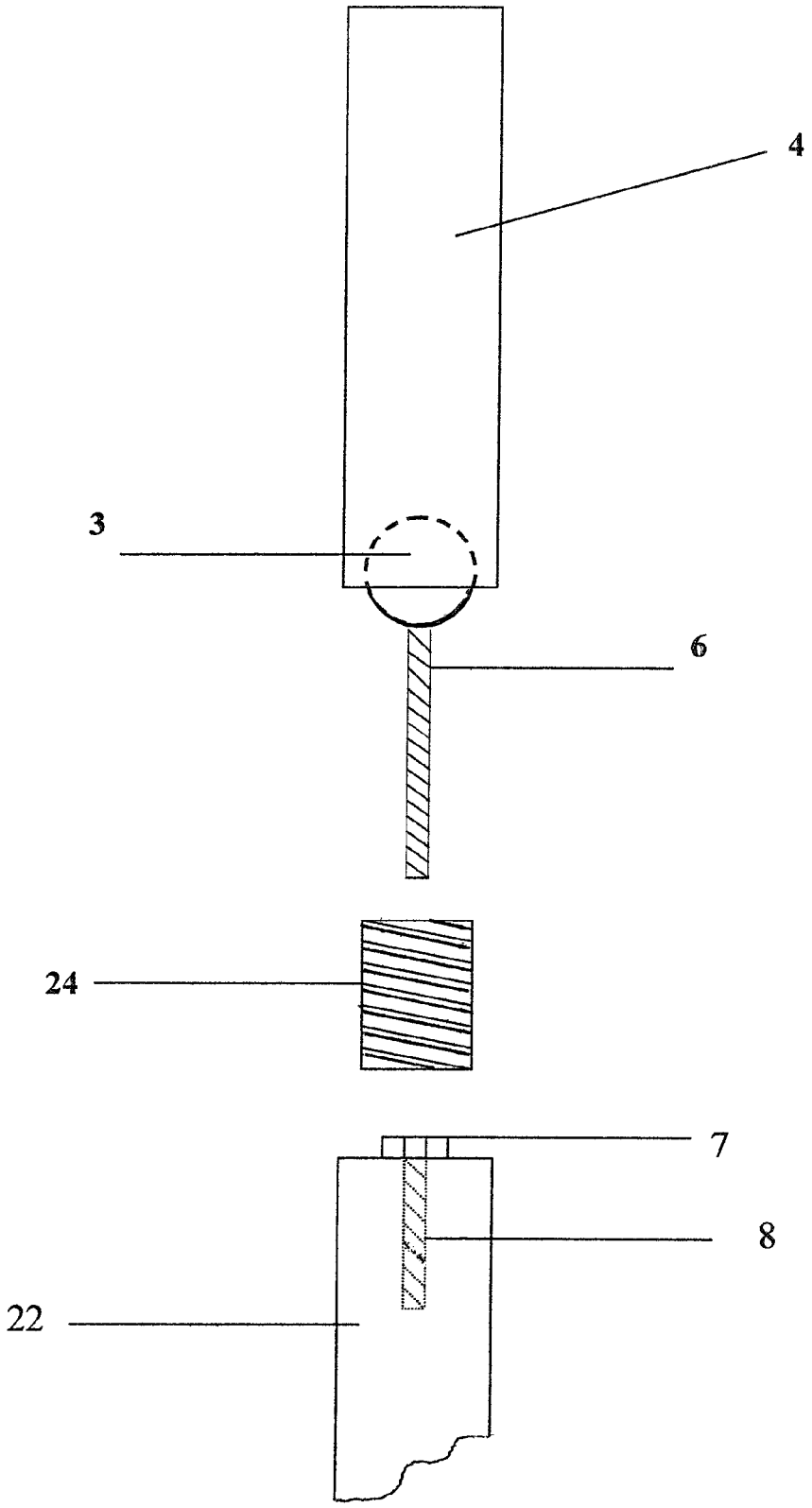
FIG. 7 shows an exploded view corresponding to FIG. 5.

FIG. 5 and FIG. 7 respectively show a detailed view and an exploded view of the ball and socket joint 3 of the swivel and swing handle 4 and its connection to the upper end of the upright portion 22 of the vacuum cleaner. The ball and socket joint 3 comprises a ball embedded in a socket at one end of the swivel and swing handle 4 and a connecting bolt 6 extending from the ball. A locking nut 7 is affixed to the upper end of the upright portion 22. A threaded bolt hole 8 is drilled inside the upper end of the upright portion 22. The swivel and swing handle 4 is connected to the upright portion 22 by screwing the connecting bolt 6 into the threaded bolt hole 8 and tightening the bottom of the ball of the ball and socket joint 3 against the locking nut 7. Alternatively, a matching nut (not shown) may be provided around the connecting bolt 6 so that it is the matching nut, instead of the bottom of the ball and socket joint 3, that is tightened against the locking nut 7.

A spiral spring 24 surrounding the part of the connecting bolt 6 between the handle 4 and the upper end of the upright portion 22 of the vacuum cleaner can be further provided to enable the handle 4 to return to its normal upright position when it is released from grip or not in use. When then handle 4 is swung to one side, the spiral spring 24 is compressed on that side; therefore, when the handle 4 is released from grip, the spiral spring 24 will push the handle to its normal upright position.

Figure 6:
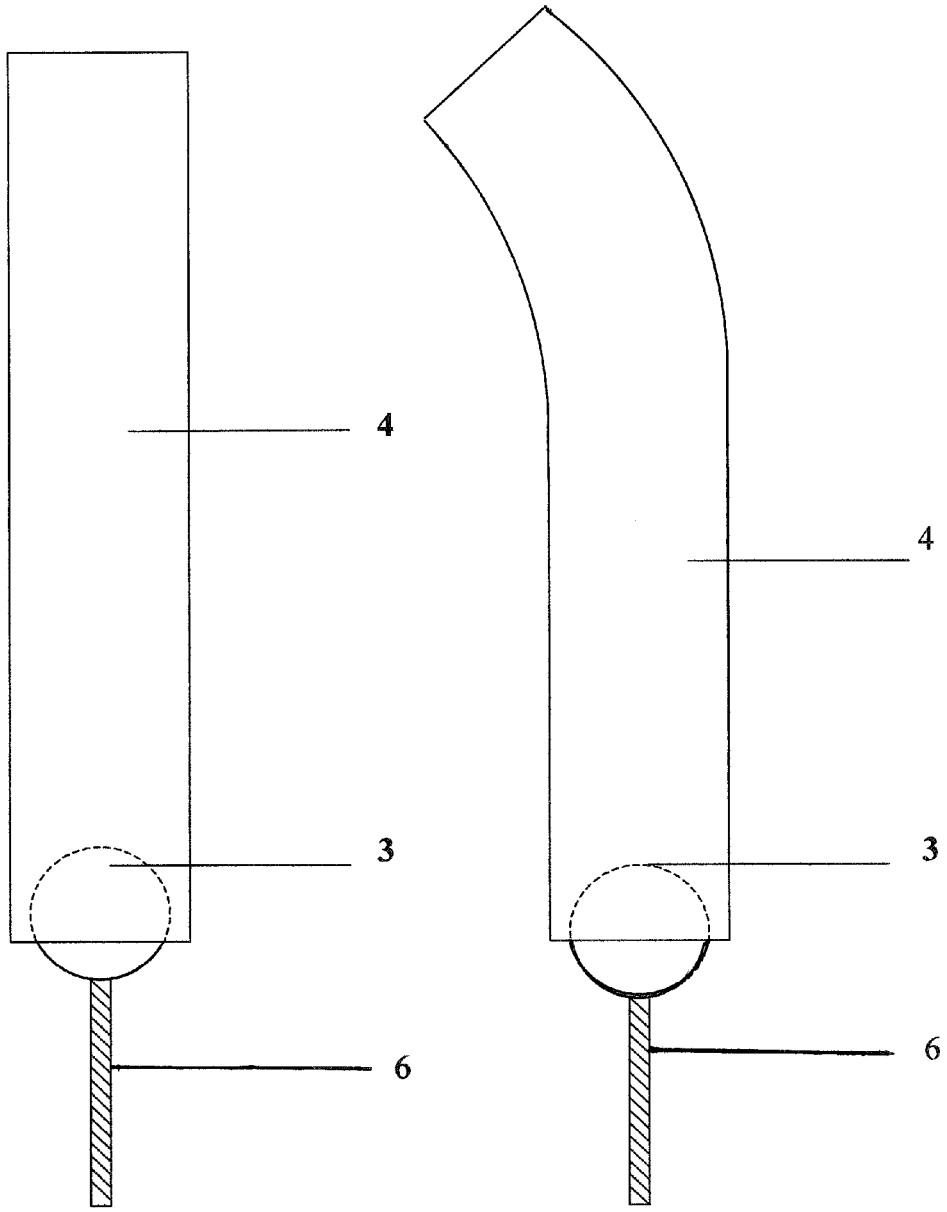
FIG. 6 shows two alternative shapes of the swivel and swing handle according to the present invention.

In FIGS. 2-5 and 7, the swivel and swing handle 4 is straight without an angled or curved end, which is common in a conventional model. This is possible because the swivel and swing handle 4 already allows the handle to swivel and swing easily, rendering the angled or curved end less useful. However, as shown in FIG. 6, the swivel and swing handle 4 can also have an angled or curved end. Like handles in conventional models, the swivel and swing handle 4 can also be molded with various gripping surfaces for the user to grasp the handle tightly and comfortably.

Another advantage with the vacuum cleaner with a swivel and swing handle is that handles with different lengths, shapes, sizes and gripping surfaces can be interchangeably fitted with the same vacuum cleaner as long as the connecting bolt 6 matches the threaded bolt hole 8 inside the upper end of the upright portion 22 of the vacuum cleaner.

With the new upright vacuum cleaner with the swivel and swing handle, the user can easily change directions of its movement, turn around corners, reach under low clearance, etc. with less physical exertion and fewer changes in bodily stance than if a conventional upright vacuum cleaner is used. For example, the user can easily change the direction of the movement by about 200 degrees by wrist action only, without changing bodily stance. Moreover, instead of having to raise the handle of the vacuum cleaner up with a bent elbow, the user can hold the swivel and swing handle and hanging it straight down at one side of the body, with the arm in a natural relaxed position, as in walking. Furthermore, when the vacuum cleaner with the swivel and swing handle is drawn back, it can be drawn farther behind the body. Then, when the arm drawing back the vacuum cleaner swings back, the gravity will help the arm push the vacuum cleaner forward, all without bending the elbow.

Despite its usefulness, a vacuum cleaner with swivel and swing handle according to the present invention has never been available to consumers. Apparently, the invention is not obvious to one skilled in the art, beside its being new and useful. Therefore, this invention with the following claims should be patentable.

I claim:

1. A vacuum cleaner assembly with a swivel and swing handle, comprising:

a wheeled base equipped with a motor;

an upright portion having an upper end and a lower end defining a longitudinal axis that extends from the upper end to the lower end, and wherein the lower end is pivotally connected to the wheeled base;

a handle having a first end and a second end defining a longitudinal axis that extends from the first end to the second end;

a gripping surface between the first end and the second end; and a ball and socket joint connected to the first end of the handle and detachably connected to the upper end of the upright portion such that the handle rotates freely around the longitudinal axis of the upright portion during use and such that the longitudinal axis of the upright portion and the longitudinal axis of the handle form an angle that varies freely from 180° to at least 160° during use.

2. The vacuum cleaner assembly with a swivel and swing handle of claim 1, wherein the detachable connection between the ball and socket joint and the upper end of the upright portion comprises a connecting bolt extending from the ball and socket joint and connected to the upper end of the upright portion.

3. The vacuum cleaner assembly with a swivel and swing handle of claim 2, wherein the connecting bolt is threaded and is screwed into a matching threaded bolt hole inside the upper end of the upright portion.

4. The vacuum cleaner assembly with a swivel and swing handle of claim 3, further comprising a locking nut affixed to the upper end of the upright portion and capable of tightening against a matching nut around the connecting bolt.

5. A vacuum cleaner assembly comprising:

a wheeled base equipped with a motor;

an upright portion having an upper end and a lower end defining a longitudinal axis that extends from the upper end to the lower end, and wherein the lower end is pivotally connected to the wheeled base;

a first handle having a first end and a second end defining a longitudinal axis that extends from the first end to the second end;

a first gripping surface between the first end of the first handle and the second end of the first handle;

a first ball and socket joint connected to the first end of the first handle and detachably connected to the upper end of the upright portion such that the first handle rotates freely around the longitudinal axis of the upright portion during use and such that the longitudinal axis of the upright portion and the longitudinal axis of the first handle form an angle that varies freely from 180° to at least 160° during use;

a second handle having a first end and a second end defining a longitudinal axis that extends from the first end to the second end;

a second gripping surface between the first end of the second handle and the second end of the second handle; and a second ball and socket joint connected to the first end of the second handle and detachably connected to the upper end of the upright portion such that the second handle rotates freely around the longitudinal axis of the upright portion during use and such that the longitudinal axis of the upright portion and the longitudinal axis of the second handle form an angle that varies freely from 180° to at least 160° during use;

wherein the first gripping surface and the second gripping surface have different shapes, and wherein the first handle and the second handle are interchangeably detachably connected to the upper end of the upright portion, allowing the first handle to be detached from the vacuum cleaner assembly and the second handle to then be connected to the vacuum cleaner assembly.

6. A vacuum cleaner assembly with a swivel and swing handle comprising:

a wheeled base equipped with a motor;

an upright portion having an upper end and a lower end defining a longitudinal axis that extends from the upper end to the lower end, and wherein the lower end is pivotally connected to the wheeled base;

a handle having a first end and a second end defining a longitudinal axis that extends from the first end to the second end;

a gripping surface between the first end and the second end; and means for detachably connecting the first end of the handle to the upper end of the upright portion such that the handle rotates freely around the longitudinal axis of the upright portion during use, and such that the longitudinal axis of the upright portion and the longitudinal axis of the handle form an angle that varies freely from 180° to at least 160° during use.

* * * * *